US008727110B2

(12) United States Patent
Walsh

(10) Patent No.: US 8,727,110 B2
(45) Date of Patent: May 20, 2014

(54) JEWELRY ORGANIZING STORAGE SYSTEM

(71) Applicant: Donna Walsh, Monroe, NY (US)

(72) Inventor: Donna Walsh, Monroe, NY (US)

( * ) Notice: Subject to any disclaimer, the term of this patent is extended or adjusted under 35 U.S.C. 154(b) by 0 days.

(21) Appl. No.: 13/849,174

(22) Filed: Mar. 22, 2013

(65) Prior Publication Data

US 2013/0256159 A1 Oct. 3, 2013

Related U.S. Application Data

(60) Provisional application No. 61/619,782, filed on Apr. 3, 2012.

(51) Int. Cl.
*B65D 73/00* (2006.01)

(52) U.S. Cl.
USPC ..... 206/6.1; 206/806

(58) Field of Classification Search
USPC ..... 206/6.1, 566, 477, 478, 479, 495, 483, 206/349, 806; 383/38
See application file for complete search history.

(56) References Cited

U.S. PATENT DOCUMENTS

D236,552 S 8/1975 Wagner
3,900,060 A * 8/1975 Shammas ..... 206/6.1
4,401,219 A * 8/1983 Mink ..... 206/566
D276,004 S 10/1984 Mink
4,735,246 A * 4/1988 Niehaus ..... 206/6.1
D297,283 S 8/1988 Gray
4,821,883 A 4/1989 Miller
4,930,635 A 6/1990 Hotchkiss et al.
5,025,918 A * 6/1991 Bergeron ..... 206/750
5,071,000 A 12/1991 Stewart
5,121,833 A * 6/1992 Lindsay et al. ..... 206/6.1
5,141,113 A 8/1992 Elliott
5,219,071 A 6/1993 Knapp
5,259,497 A * 11/1993 Brothers et al. ..... 206/6.1
5,295,587 A 3/1994 Downes et al.
5,363,953 A * 11/1994 Carter ..... 206/6.1
5,427,230 A * 6/1995 Mattox ..... 206/6.1
D360,795 S 8/1995 Saunders
5,593,025 A 1/1997 Feibelman
5,680,928 A * 10/1997 Carr ..... 206/6.1
5,779,033 A 7/1998 Roegner
5,890,587 A 4/1999 Roegner
D458,752 S 6/2002 Wolf
6,959,806 B2 11/2005 Barker (Continued)

*Primary Examiner* — Jacob K Ackun
(74) *Attorney, Agent, or Firm* — Buckingham, Doolittle & Burroughs, LLC

(57) ABSTRACT

A jewelry storage organizer system is disclosed that provides for a more effective way to store and travel with a large variety of jewelry. The jewelry storage organizer system comprises a jewelry-organizing device, an earring-organizing device, and a necklace-organizing device. The jewelry storage organizer device comprises a singular sheet that comprises a plurality of tab closures, multiple ring bars, and at least one jewelry pocket for retaining jewelry. The jewelry storage organizer device can be hung on a door and rolled into a cylindrical configuration for storage or transportation. The earring storage organizer device comprises a singular sheet and a plurality of perforated tabs for retaining post earrings. The earring storage organizer device can be rolled up into a cylindrical configuration and can stand upright on its end. The necklace storage organizer device comprises a sheet and tab closures secured onto the front surface for retaining a necklace.

5 Claims, 8 Drawing Sheets

(56) References Cited

U.S. PATENT DOCUMENTS

| | | | | |
|---|---|---|---|---|
| 7,389,868 | B2 * | 6/2008 | Lewand et al. | 206/6.1 |
| 7,490,718 | B2 | 2/2009 | Shen | |
| 2004/0050720 | A1 | 3/2004 | Harris | |
| 2005/0139558 | A1 | 6/2005 | Kephart | |
| 2007/0045130 | A1 | 3/2007 | Kim | |
| 2009/0230000 | A1 | 9/2009 | Sackos | |
| 2010/0170810 | A1 | 7/2010 | Shulman | |
| 2012/0241329 | A1 * | 9/2012 | Gaspari et al. | 206/6.1 |

* cited by examiner

JEWELRY ORGANIZING STORAGE SYSTEM

CROSS-REFERENCE

This application claims priority from Provisional Patent Application Ser. No. 61/619,782 filed Apr. 3, 2012.

BACKGROUND

Today's fashion era incorporates a large amount of costume jewelry into accessorizing each fashion design. Women and teenage girls, who purchase this jewelry, now need more effective ways to house, organize, and travel with all their jewelry. Furthermore, most of this jewelry usually becomes broken and tangled because it is stored in or on ineffective devices. Most jewelry organizers cause jewelry to become tangled, and do not hold a lot of the larger, more bulky jewelry of this era. Furthermore, the spaces provided in current existing organizers, are not appropriately sized for this larger type of jewelry.

For example, some jewelry organizers are made to be hung in closets or to be stored in drawers, not in direct view. This results in women not having quick, easy access to their jewelry. Further, most tabletop jewelry organizers hold very little jewelry and are not suited for larger types of costume jewelry. Jewelry armoires are large, expensive piece of furniture, and are also constructed to hold more delicate jewelry. Pocket jewelry organizers are ineffective, as jewelry drops down into the pocket making it difficult to see and even harder to retrieve. Further, jewelry organizers that are meant to hang on the wall cause a user to damage their wall and cause necklaces to hang very close together or on top of each other where they can become tangled.

Additionally, women and teenage girls also need better traveling containers for their larger, more bulky costume jewelry. None of the previously discussed jewelry organizers are able to quickly condense the jewelry for travel, while keeping it still in its displayed position where it remains in tact and tangle free. Thus, a jewelry organizer storage device that effectively stores, organizes, and transports large amounts of jewelry, including costume jewelry is necessary.

The present invention provides a three-piece set focusing on the fact that not all types of jewelry can be effectively stored in one form. The jewelry organizer storage system comprises a jewelry-organizing device for a large variety of jewelry, an earring-organizing device, and a necklace-organizing device for chunky choker necklaces. The jewelry system can organize a large amount of jewelry, including costume jewelry, in direct view. All devices to the system have the ability to close quickly to keep the jewelry safely stored and discretely hidden and also open quickly for easy access to the jewelry. It accommodates both larger and smaller pieces of jewelry all in an organized tangle-free manner. The jewelry system can also become a travel form in seconds. Thus, a user no longer needs to pick out select pieces of jewelry and transfer them to a travel case. The jewelry system provides an easy and hassle-free device for displaying, storing and transporting any type of jewelry. Any woman or teenage girl would benefit from the convenience and efficiency this system provides. Most women and teenage girls currently live within a fast paced society. The easy grab-n-go feature that these organizers provide will help to simplify the wardrobe accessorizing routine of all women and teenage girls, which can bring more ease to life.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a jewelry organizer storage system that provides for a more effective way to house, organize, and travel with a large amount of jewelry, including a large amount of costume jewelry. The jewelry organizer storage system comprises a jewelry-organizing device for a large variety of jewelry, an earring-organizing device, and a necklace-organizing device for chunky choker necklaces. The jewelry storage organizer device for a large variety of jewelry comprises a generally elongated singular sheet divided into multiple sections. The singular sheet further comprises a plurality of tab closures, multiple ring bars, and at least one jewelry pocket secured to the front surface of the singular sheet for retaining jewelry, such as necklaces, earrings, rings, etc. The jewelry storage organizer device can be hung on a door with provided hooks that can adjust to any door width and/or rolled into a cylindrical configuration so that the jewelry remains condensed and stored out of view. In the cylindrical configuration, the device can easily be removed from the hooks for transportation.

Similarly, the earring storage organizer device also comprises a generally elongated singular sheet comprising a first end and a second end and a plurality of perforated tabs secured onto the front surface of the singular sheet for retaining post earrings. The singular sheet can be rolled into a cylindrical configuration and secured for the purpose of creating a rigid form for displaying and retaining earrings. Once the earrings are attached to the cylindrical form, this form can now be rolled into a tight scroll for the means of condensing the earrings for discrete storage and or transport.

Additionally, the necklace storage organizer device for chunky choker-like necklaces comprises a generally elongated singular sheet comprising a first end and a second end, and tab closures secured onto the front surface of the singular sheet for retaining a necklace. Once the necklace is secured, the singular sheet can be placed within an interior section of a storage bag. In a preferred embodiment of the necklace storage organizer device, approximately eight necklaces can be inserted into the interior sections of the storage bag. Further, one soft fabric pocket is included with the necklace storage organizer device for the purpose of transporting just a few necklaces as apposed to transporting the entire storage bag.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
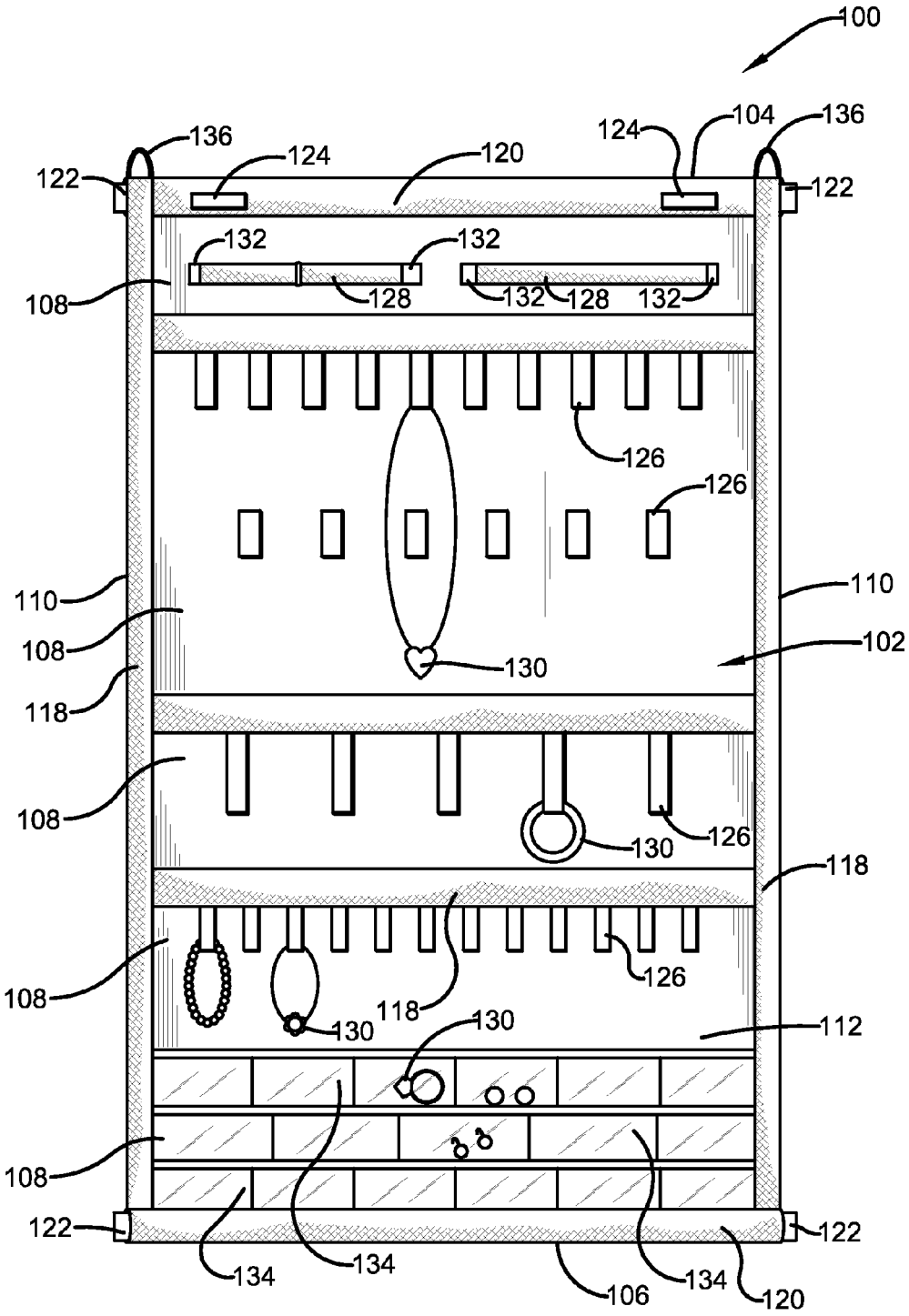
FIG. 1 illustrates a front perspective view of the jewelry storage organizer device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention provides a three-piece jewelry organizing set focusing on the fact that not all types of jewelry can be effectively stored in one form or a single device. The jewelry organizer storage system comprises a jewelry-organizing device for a large variety of jewelry, an earring-organizing device, and a necklace-organizing device for chunky choker necklaces. The jewelry system can organize a large amount of costume jewelry in direct view. It accommodates both larger and smaller pieces of jewelry all in an organized tangle-free manner. The jewelry system can also become a travel form in seconds. The jewelry system provides a hassle-free device for storing jewelry with a convenient quick and easy access concept, and also allows for each organizer device to effortlessly convert to a travel form.

The jewelry storage organizer device for a large variety of jewelry comprises a singular sheet divided into multiple sections, a plurality of tab closures, multiple ring bars, and at least one jewelry pocket for retaining jewelry. The jewelry storage organizer device can be hung on a door and/or rolled into a cylindrical configuration for easy transportation and/or storage. The jewelry can be discretely stored within the scrolled cylinder, where the user can at will easily open the scroll for access to the jewelry, and quickly close it again for discrete storage. While the jewelry storage organizer device is in its scrolled position, it can quickly and easily be removed from its hanging mechanism for transport. Furthermore, the earring storage organizer device comprises a singular sheet and a plurality of perforated tabs for retaining post earrings. The earring storage organizer device can be rolled up into a cylindrical configuration and can stand upright on its end so that the earrings are retained and displayed on this cylindrical-shaped structure. Further, the necklace storage organizer device for chunky choker necklaces comprises a sheet and tab closures secured onto the front surface for retaining a necklace. Exact dimensions or materials used for all the jewelry storage organizer devices may vary to suit manufacturing needs and/or user preference.

Figure 2:
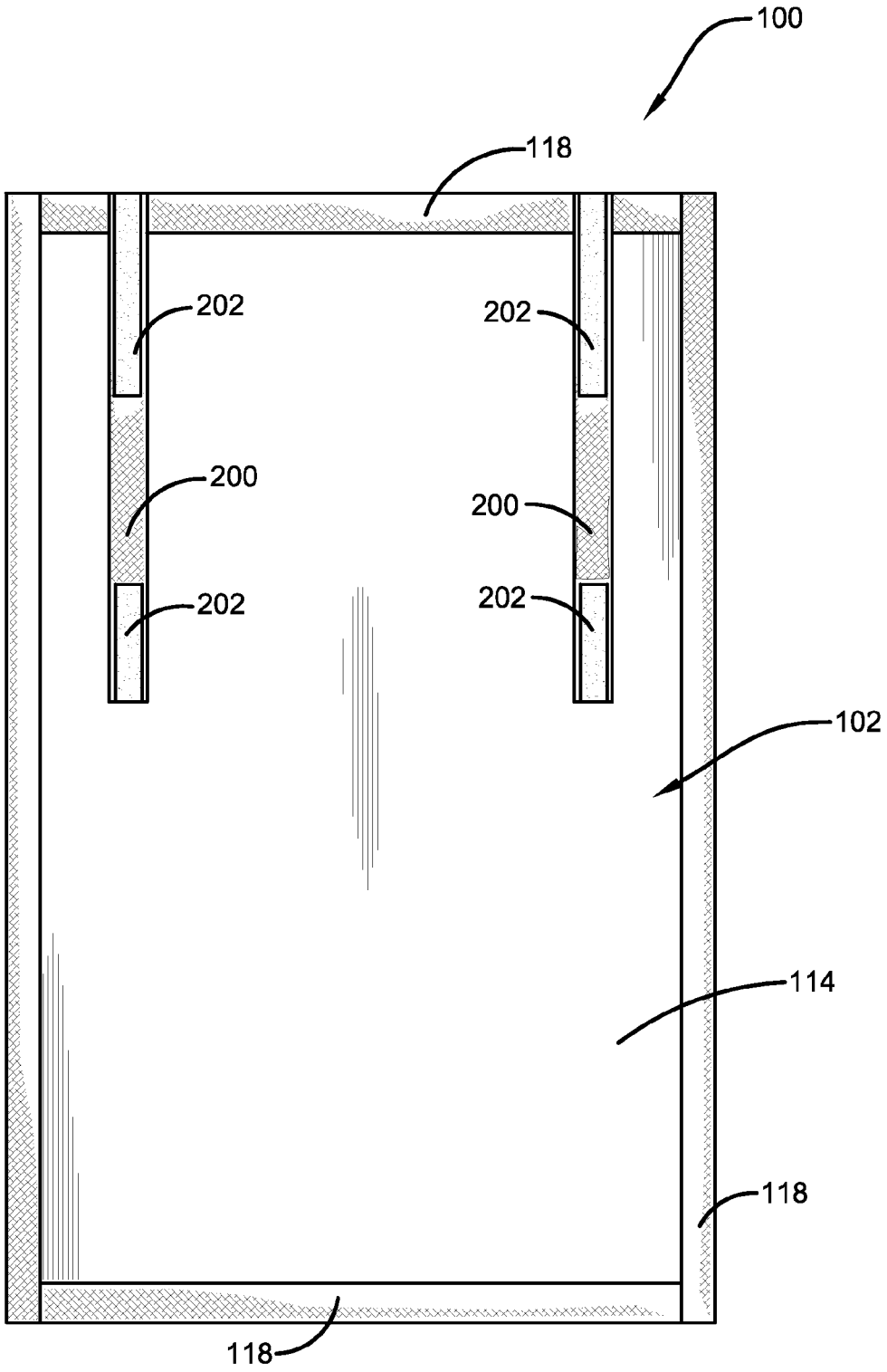
FIG. 2 illustrates a back perspective view of the jewelry storage organizer device in accordance with the disclosed architecture.
Figure 3:
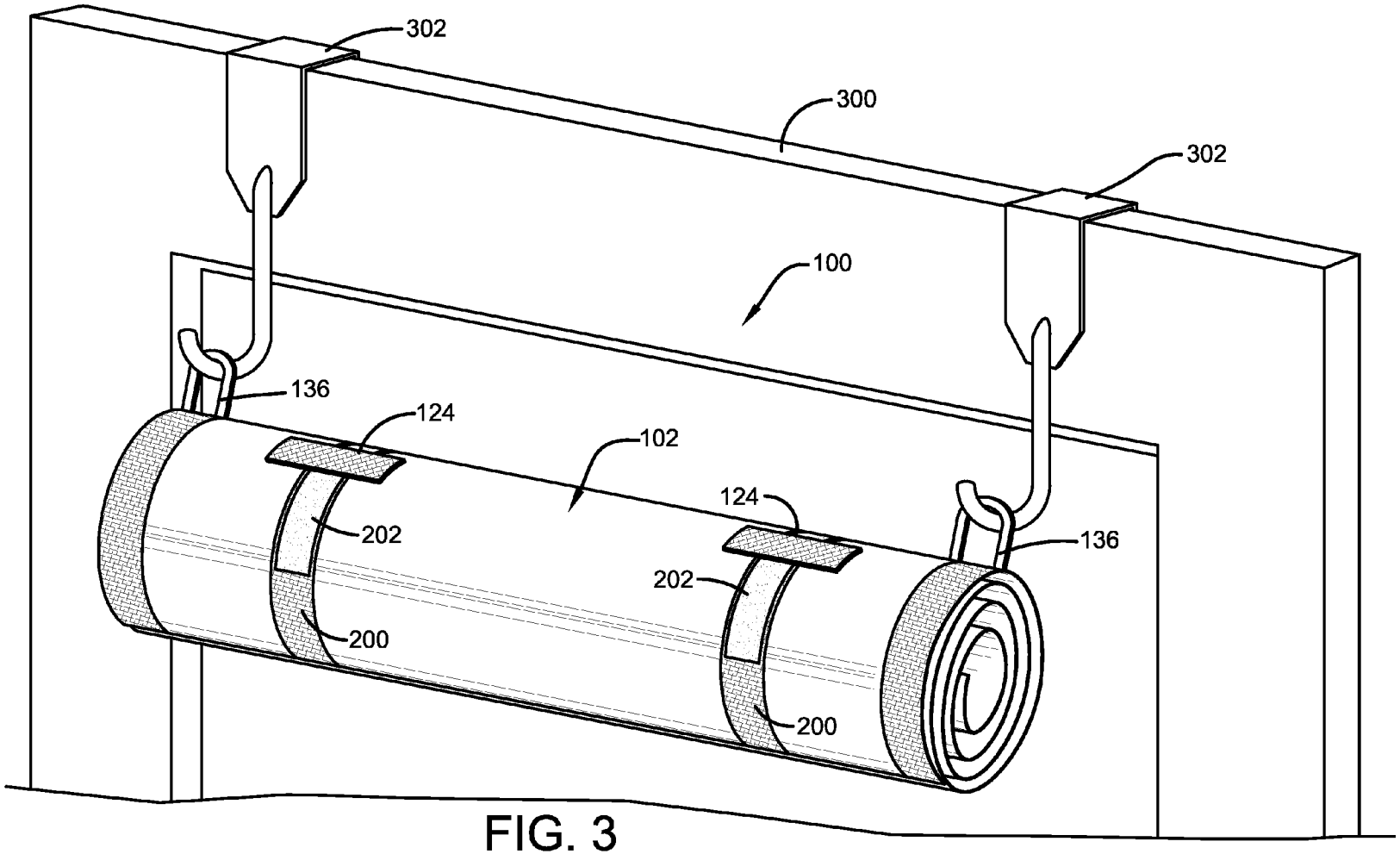
FIG. 3 illustrates a perspective view of the jewelry storage organizer device rolled up in a cylindrical configuration in accordance with the disclosed architecture.

Referring initially to the drawings, FIGS. 1-3 illustrate the jewelry storage organizer device 100 that provides for a more effective way to house, organize, and travel with a large amount of jewelry, including a large amount of costume jewelry. The jewelry storage organizer device 100 comprises a generally elongated singular sheet 102 comprising a first end 104 and a second end 106 and divided into multiple sections 108. Typically, the elongated singular sheet 102 is rectangular in shape, however any other suitable shape can be used as is known in the art without affecting the overall concept of the invention.

The elongated singular sheet 102 would generally be constructed of woven wood, fabric, or plastic sheets, etc., though any other suitable material may be used to manufacture the elongated singular sheet 102 as is known in the art without affecting the overall concept of the invention. The elongated singular sheet 102 can also comprise a variety of colors and designs to suit user and manufacturing preference. Further, the elongated singular sheet 102 is approximately between 52 and 53 inches long as measured from the first end 104 to the second end 106, and approximately between 22 and 23 inches wide as measured from opposing sides 110, and approximately between 1/16 and 2/16 inches thick as measured from the front surface 112 to the back surface 114.

Additionally, the elongated singular sheet 102 can be divided into multiple sections 108 for the storage of jewelry. The elongated singular sheet 102 can be divided into any suitable number of sections 108 as is known in the art without affecting the overall concept of the invention, as shown in FIG. 1. Generally, the elongated singular sheet 102 is divided into multiple sections 108 via decorative fabric banding 118 that is sewn onto the elongated singular sheet 102 at predetermined positions. However, decorative fabric banding 118 does not have to be used and any suitable material can be used to divide the singular sheet 102 into multiple sections 108. Further, the decorative fabric banding 118 can also be secured to the perimeter of the singular sheet 102 creating a border. The decorative fabric banding 118 is secured to the front surface 112 of the singular sheet 102 via any suitable securing means as is known in the art, such as gluing, sewing, etc.

The singular sheet 102 further comprises a plurality of tab closures 126 secured onto the front surface 112 of the singular sheet 102 (as shown in FIG. 1) for retaining jewelry 130. The plurality of tab closures 126 comprise hook and loop closures (or fasteners) for opening and closing the tab closures and securing the jewelry within the tab closure. The tab closures 126 are typically decorative fabric banding which comprise strips of hook and loop fasteners (Velcro®) or other suitable securing devices as is known in the art on the ends to allow the tab closures 126 to be opened and closed. The plurality of tab closures 126 can be secured via any suitable securing means as is known in the art, such as sewing, gluing, etc., to the front surface 112 of the singular sheet 102. The plurality of tab closures 126 can be secured in any suitable configuration within the multiple sections 108.

The singular sheet 102 can also comprise multiple ring bars 128 secured to the front surface 112 of the singular sheet 102 for storing rings. Typically, the ring bars 128 are cylindrical-shaped components that are covered in fabric or other suitable material. The ring bars 128 are secured to the front surface 112 via any suitable securing means as is known in the art, such as sewing, gluing, etc. The ring bars 128 can be secured in any suitable configuration within the multiple sections 108. The ends 132 of the ring bars 128 comprise hook and loop fasteners (or Velcro® tabs), which allow the ring bars 128 to be opened and closed, such that rings can be inserted onto the ring bars 128 and secured.

Additionally, the singular sheet 102 comprises at least one jewelry pocket 134 secured to the front surface 112 of the singular sheet 102 for storing miscellaneous small jewelry items 130. The jewelry pocket 134 typically comprises a clear plastic front panel, such that any jewelry 130 placed within the jewelry pocket 134 can be viewed without opening the jewelry pocket 134. However, the jewelry pocket 134 does not have to comprise a clear plastic front panel, and can function with an opaque front panel as well. The jewelry pocket 134 is secured to the front surface 112 via any suitable securing means as is known in the art, such as sewing, gluing, etc. The jewelry pocket 134 can be any suitable size and configuration and can be secured in any suitable configuration within the multiple sections 108.

The singular sheet 102 further comprises at least one open-ended sleeve 120 formed at the second end 106. Typically, the singular sheet 102 comprises two open-ended sleeves 120, with an open ended sleeve 120 formed at both the first end 104 and the second end 106. The open-ended sleeves 120 are formed by folding the first end 104 and second end 106 over by approximately two inches at both ends. The folded over first end 104 and second end 106 are secured to the singular sheet 102 by any suitable means as is known in the art, such as sewing, gluing, etc. The open-ended sleeves 120 are configured to receive a flat plank-like structure 122, or other suitably-shaped structure as is known in the art.

The flat plank-like structure 122 would generally be constructed of cardboard, plastic, aluminum, etc., or any other rigid material as is known in the art without affecting the overall concept of the invention. The flat plank-like structure 122 allows a user to roll up the singular sheet 102 into a cylindrical configuration (or scroll of jewelry) for travel or storage (as shown in FIG. 3). A user would start at the bottom or second end 106 of the singular sheet 102 and grasp the solid plank-like structure 122 secured within the sleeve 120. The user then proceeds to roll the singular sheet 102 up towards the top or first end 104 of the singular sheet 102, rotating the plank-like structure 122 as they roll and creating a tight scroll of material (i.e., a cylindrical configuration of the singular sheet 102). This flat plank-like structure 122 is what allows the singular sheet 102 to roll up effectively while retaining the large amount of jewelry.

The singular sheet 102 can further comprise securement components, which act to secure the singular sheet 102 in the cylindrical configuration. Specifically, the securement components can comprise straps 200 or other suitable components as is known in the art. The straps 200 are typically decorative fabric banding which comprise strips of hook and loop fasteners 202 (Velcro®) or other suitable securing devices as is known in the art. The straps 200 and hook and loop fasteners 202 are partially or completely secured to the back surface 114 of the singular sheet 102 via any suitable securing means as is known in the art, such as sewing, gluing, etc. (as shown in FIG. 2).

Further, the front surface 112 of the singular sheet 102 can comprise raised tabs 124 or loops which act to engage the straps 200, securing the singular sheet 102 in a cylindrical configuration. Specifically, once the singular sheet 102 is rolled into the cylindrical configuration, the straps 200 are threaded through the raised tabs 124 and folded approximately 180 degrees in a reverse direction such that the straps 200 engage the hook and loop fasteners 202, which secure the straps 200 together, and secures the singular sheet 102 in a cylindrical configuration. This keeps the singular sheet 102 closed, and secures all the jewelry within the rolled up singular sheet 102. This method of closure, provides a quick one step open and close feature, giving the user quick and easy access to the jewelry. Also, once the singular sheet 102 is rolled into a cylindrical configuration, a user can either keep the jewelry stored within the scroll while hanging on its hanging mechanism, or remove the scroll for transport without worrying about losing jewelry.

The singular sheet 102 further comprises a hanging component 136 secured to the first end 104 of the singular sheet 102 for hanging the singular sheet 102 on a vertical surface, such as a door 300 (as shown in FIG. 3). The hanging component 136 is typically loops which engage hooks 302 on the door 300 or other vertical surface, or the hanging component 136 can be any suitable securing component as is known in the art. The singular sheet 102 can be hung on a door 300 or other vertical surface via the hanging component 136. While hanging, the singular sheet 102 can be rolled-up into a cylindrical configuration for storage of the jewelry without ever needing to remove it from the hooks 302 secured to the door 300.

As stated supra, a user would start at the bottom or second end 106 of the singular sheet 102 and grasp the flat plank-like structure 121 secured within the open-ended sleeve 120. The user then proceeds to roll the singular sheet 102 up towards the top or first end 104 of the singular sheet 102, rotating the solid plank-like structure 121 as they roll and creating a tight scroll of material (i.e., a cylindrical configuration of the singular sheet 102), which is then secured via wrapping the straps 200 upward around the cylindrical configuration of the sheet 102 and slipping each end of the straps 200 into the open raised tabs 124 and pulling down tightly toward the ground to secure the sheet 102 in the cylindrical configuration, securing the jewelry inside. To release the sheet 102, a user lifts the straps 200 upward, releasing the Velcro® closure and lets the singular sheet 102 slowly roll down the door 300, and the jewelry 130 remains intact, tangle free, and in full view for display and easy access.

FIGS. 4-6 and 6A illustrate the earring storage organizer device 400 that provides for a more effective way to house, organize, display, and travel with a large amount of earrings. The earring storage organizer device 400 comprises a generally elongated singular sheet 402 comprising a first end 404 and a second end 406. Typically, the elongated singular sheet 402 is rectangular in shape, however any other suitable shape can be used as is known in the art without affecting the overall concept of the invention.

The elongated singular sheet 402 would generally be constructed of woven wood, cardboard, fabric, or plastic sheets, etc., though any other suitable material may be used to manufacture the elongated singular sheet 402 as is known in the art without affecting the overall concept of the invention. The elongated singular sheet 402 can also comprise a variety of colors and designs to suit user and manufacturing preference. Further, the elongated singular sheet 402 is approximately between 17 and 18 inches long as measured from the first end 404 to the second end 406, and approximately between 16 and 17 inches wide as measured from opposing sides 410, and approximately between 2/16 and 3/16 inches thick as measured from the front surface 412 to the back surface 414.

Typically, the elongated singular sheet 402 comprises a fabric overlay that is secured to the back surface 414 of the singular sheet 402. However, the overlay does not have to comprise fabric and can be any suitable material as is known in the art that protects the earrings 430 when the singular sheet 402 is rolled into a cylindrical configuration (tight scroll) and allows for a pliable movable function. Further, the fabric overlay is secured to the back surface 414 of the elongated singular sheet 402 via any suitable securing means as is known in the art, such as sewing, gluing, etc.

Additionally, the elongated singular sheet 402 can also comprise a decorative fabric banding 418 secured to the perimeter of the singular sheet 402 creating a border. The decorative fabric banding 418 is secured to the front surface 412 of the singular sheet 402 via any suitable securing means as is known in the art, such as gluing, sewing, etc. Furthermore, decorative fabric banding 418 does not have to be used and any suitable material can be used as is known in the art.

Figure 4:
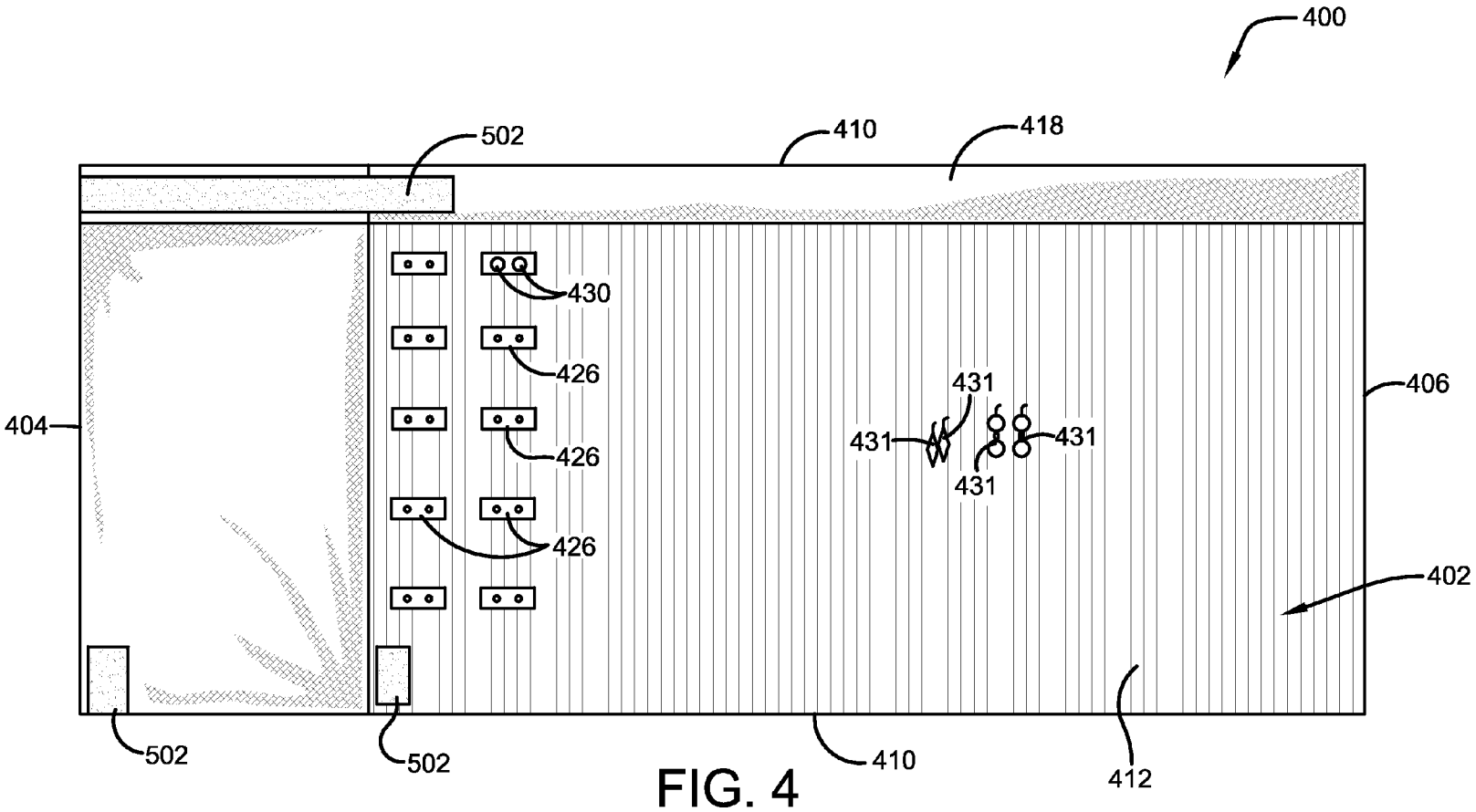
FIG. 4 illustrates a front perspective view of the earring storage organizer device in accordance with the disclosed architecture.

The singular sheet 402 further comprises a plurality of perforated tabs 426 secured onto the front surface 412 of the singular sheet 402 (as shown in FIG. 4) for retaining post earrings 430. The earrings 430 are secured directly on the perforated tabs 426. The perforated tabs 426 are typically decorative fabric banding which is perforated or any other suitable material as is known in the art. The plurality of perforated tabs 426 can be secured via any suitable securing means as is known in the art, such as sewing, gluing, etc., to the front surface 412 of the singular sheet 402. The plurality of perforated tabs 426 can be secured in any suitable configuration on the singular sheet 402. The remaining area on the elongated singular sheet 402 where the perforated tabs 426 are not present, is where hanging earrings 431 can be retained by means of piercing the wire hook of the hanging earring 431 through the front surface 412 of the elongated singular sheet 402

Figure 5:
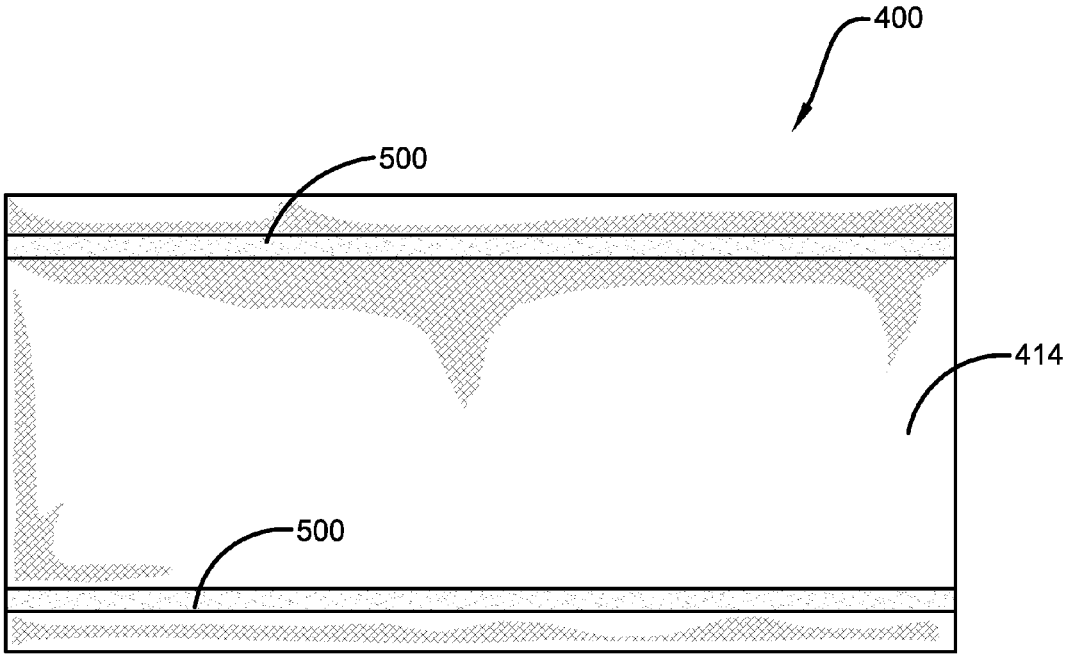
FIG. 5 illustrates a back perspective view of the earring storage organizer device in accordance with the disclosed architecture.

Typically, the singular sheet 402 is held erect and rolled into a cylindrical configuration to allow for the placement and retention of the earrings 430 and 431. The earrings 430 and 431 will then be displayed and retained on the front surface 412 of the singular sheet 402 when it is in its cylindrical form. The cylindrical configuration is achieved by first standing the singular sheet 402 up on its side 410 so that it is erect, then starting at the second end 406 and moving the end 406 in a counter clockwise direction until it meets the first end 404. The cylindrical shape is secured closed by securement components. Specifically, the securement components can comprise strips 500 of hook and loop fasteners (Velcro®) or other suitable securing components as is known in the art. The strips 500 with the hook and loop fasteners are secured to the back surface 414 of the singular sheet 402 via any suitable securing means as is known in the art, such as sewing, gluing, etc. (as shown in FIG. 5). Further, the front surface 412 of the singular sheet 402 can also comprise strips 502 of hook and loop fasteners (Velcro®) which act to engage the strips 500 from the back surface 414, securing the singular sheet 402 in a cylindrical configuration. Earrings 430 and 431 are retained and displayed on the front surface 412 of the cylindrical form. Hanging earrings 431 are retained by piercing the wire hook of the earring through the front surface 412 of the singular sheet 402, and post earrings 430, are retained and displayed on the perforated tabs 426 that have been secured to the singular sheet 402 via any suitable securing means as is known in the art, such as sewing, gluing, etc. Typically, the inner portion of the cylindrical form, which is the back surface 414, is lined with fabric.

Figure 6A:
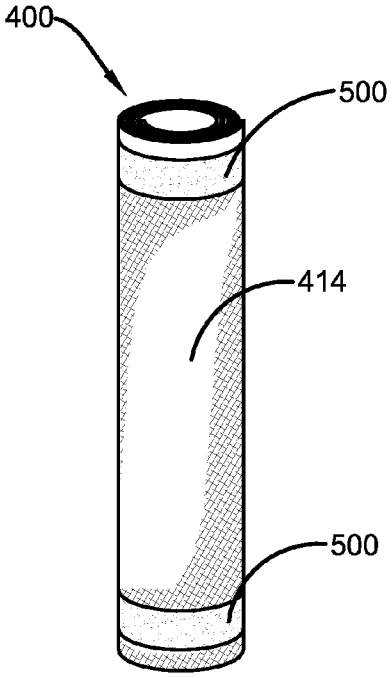
FIG. 6A illustrates a perspective view of the earring storage organizer device rolled into a tight scroll configuration for storage and travel in accordance with the disclosed architecture.
Figure 6:
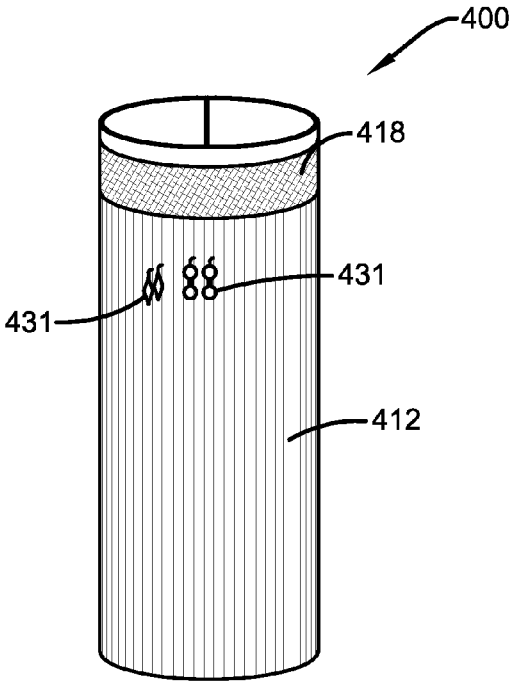
FIG. 6 illustrates a perspective view of the earring storage organizer device rolled up in a cylindrical configuration in accordance with the disclosed architecture.

The singular sheet 402, when formed into a cylindrical form for the purpose of retaining and displaying earrings 430 and 431, can quickly transform into a tightly wound compact scroll for the purpose of storing and transporting earrings 430 and 431 (as shown in FIG. 6A). The earrings 430 and 431 will remain intact and safely contained within the scroll without the worry of losing earrings 430 and 431. To transform the cylindrical form into a scroll, a user detaches the strips 502 (hook and loop fasteners) from strip 500 (hook and loop fasteners). Then the user, starting at the second end 406, while the cylindrical form is in an erect position, begins to tightly roll the singular sheet 402 in a clockwise direction. The back surface 414, upon which the fabric lining has been secured, will then lie over the exposed earrings 430 and 431 as the user rolls. The fabric lining (overlay) will also stop the wire hooks of the hanging earrings 431 from becoming caught up within each other while rolling. Once the rolling of the singular sheet 402 is completed, the second end 406 is attached to the fabric liner (or overlay) by strip 502 engaging with strip 500.

The storage and travel scroll (as shown in FIG. 6A) can quickly convert back to the cylindrical display form to once again gain access to the earrings 430 and 431. This is achieved by a user first disengaging strip 502 from strip 500. Then the user, with the scroll standing erect, begins to unroll the scroll in a counter clockwise direction till all the earrings 430 and 431 appear. The user can then form the elongated sheet 402 back into a cylindrical form and secure the sheet 402 in that form by engaging fastener strip 502 with fastener strip 500.

Figure 7:
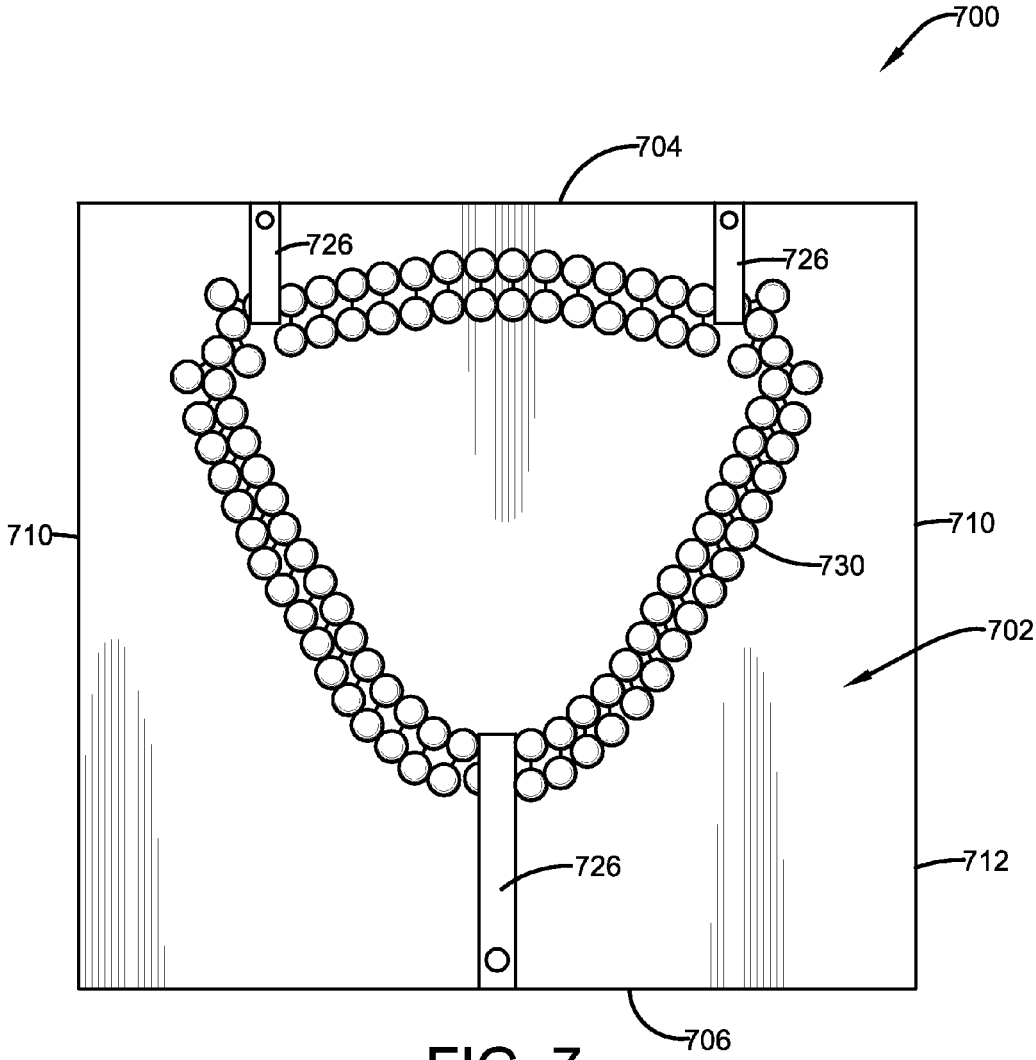
FIG. 7 illustrates a front perspective view of the necklace storage organizer device in accordance with the disclosed architecture.
Figure 8:
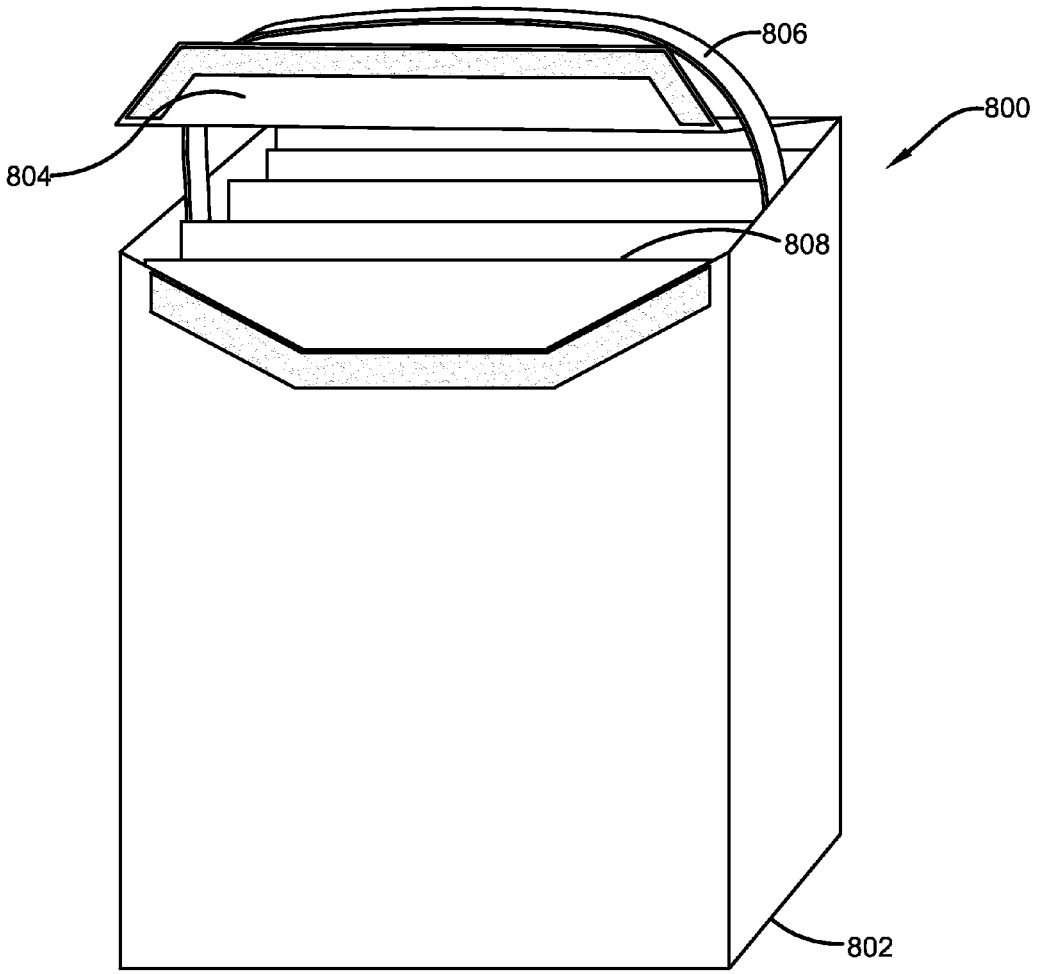
FIG. 8 illustrates a perspective view of the storage bag for the necklace storage organizer device in accordance with the disclosed architecture.
Figure 9:
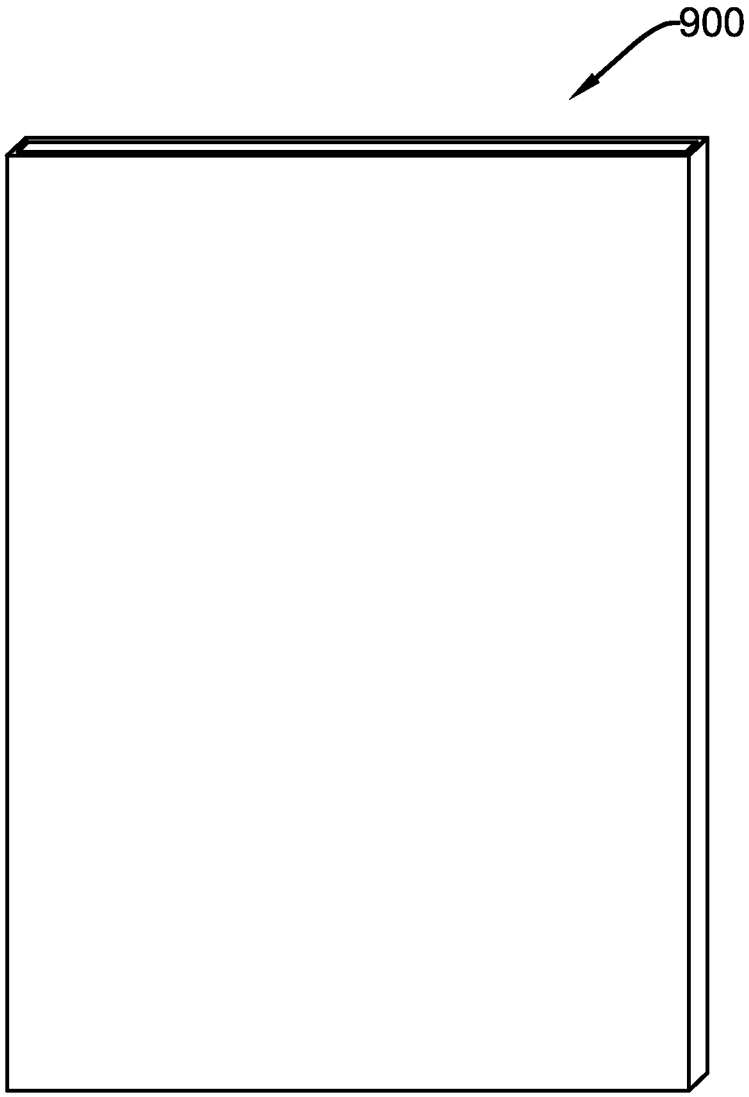
FIG. 9 illustrates a front perspective view of the storage pocket for the necklace storage organizer device in accordance with the disclosed architecture.

FIGS. 7-9 illustrate a necklace storage organizer device for chunky choker like necklaces 700 that provides for a more effective way to house, organize, and travel with a necklace or other large piece of jewelry. The necklace storage organizer device 700 comprises a generally elongated singular sheet 702 comprising a first end 704 and a second end 706. Typically, the elongated singular sheet 702 is square in shape, however any other suitable shape can be used as is known in the art without affecting the overall concept of the invention.

The elongated singular sheet 702 would generally be constructed of wood, rigid cardboard, or a hard plastic sheet, etc., though any other suitable material may be used to manufacture the elongated singular sheet 702 as is known in the art without affecting the overall concept of the invention. The elongated singular sheet 702 can also comprise a variety of colors and designs to suit user and manufacturing preference. Further, the elongated singular sheet 702 is approximately between 12 and 13 inches long as measured from the first end 704 to the second end 706, and approximately between 9 and 10 inches wide as measured from opposing sides 710, and approximately between 2/16 and 3/16 inches thick as measured from the front surface 712 to the back surface (not shown).

Typically, the elongated singular sheet 702 comprises a fabric overlay that is laminated to the front surface 712 of the singular sheet 702. However, the overlay does not have to comprise fabric and can be any suitable material as is known in the art that allows tab closures 726 to be secured via rivets, sewing or gluing to the overlay. Further, the overlay is typically laminated to the front surface 712 of the singular sheet 702, but could also be secured via any suitable securing means as is known in the art, such as gluing, sewing, etc.

The singular sheet 702 further comprises at least one tab closure 726 secured onto the front surface 712 of the singular sheet 702 for retaining a necklace 730. Typically, there are three tab closures 726 secured onto the front surface 712, wherein two tab closures 726 are secured at the first end 704 of the singular sheet 702, about 1½ inches from each side, and the third tab closure 726 is secured near the second end 706 (as shown in FIG. 7). The tab closures 726 comprise hook and loop closures (or fasteners) for opening and closing the tab closures and securing the necklace within the tab closure 726. The tab closures 726 are typically decorative fabric banding which comprise strips of hook and loop fasteners (Velcro®)

or other suitable securing devices as is known in the art on the ends to allow the tab closures 726 to be opened and closed. The tab closures 726 can be secured via any suitable securing means as is known in the art, such as a rivet, sewing, gluing, etc., to the front surface 712 of the singular sheet 702. The tab closures 726 can be secured in any suitable configuration on the singular sheet 702 as well.

Once the chunky choker necklace 730 is secured, the singular sheet 702 can be placed within the interior of a fabric pocket 900 or sleeve (as shown in FIG. 9). The pocket 900 can be manufactured of any suitable material as is known in the art, and acts to protect the necklace during transport and/or storage. The pocket 900 is just a sleeve of fabric with an opening at one side that allows the singular sheet 702 to be inserted into the interior of the pocket 900. The pocket 900 can further comprise an additional flap of material that covers the opening, but the additional flap of material is not necessary and the pocket 900 can function without it. This protective pocket 900 provides a protective covering for the transport of just a few chunky chokers necklaces 730.

Once the choker necklaces 730 have been secured onto the singular sheet 702, with tab closures 726, the singular sheet 702 can then be placed in one of the sections 808 of the storage bag 800. There are approximately eight fabric section 808 dividers within the interior of the storage bag 800 for storing approximately eight chunky choker necklaces 730. The storage bag 800 comprises a rigid bottom 802 so that the storage bag 800 can stand upright and to give the storage bag 800 form. The storage bag 800 comprises a flap 804 that closes the top and is secured with hook and loop fasteners (Velcro®), or any other suitable fasteners as is known in the art. The storage bag 800 can also comprise a strap 806 for ease in transporting the storage bag 800. Thus, once the singular sheet 702 is placed in the storage bag 800, a user can transport and travel with the chunky choker necklaces 730 without worrying about losing the necklaces 730.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A jewelry storage organizer device, comprising:

a generally elongated rectangular singular sheet of heavyweight fabric comprising a first end and a second end and divided into multiple sections;

a plurality of tab closures secured onto a front surface of the singular sheet; and at least one pocket formed at both the first end and the second end of the singular sheet;

wherein the at least one pocket comprises a flat, plank-like structure positioned within an interior of each pocket, allowing the singular sheet to be rolled into a cylindrical configuration;

two straps secured to a back surface, one on either edge of the singular sheet for securing the singular sheet in the cylindrical configuration;

two raised tabs that engage the two straps to further secure the singular sheet in the cylindrical configuration; and two hanging components secured to the first end, one on either edge of the singular sheet for hanging the singular sheet on a vertical surface; and wherein the singular sheet can be rolled-up into the cylindrical configuration or un-rolled while hanging on the vertical surface.

2. The jewelry storage organizer device of claim 1, further comprising at least one ring bar secured to the front surface of the singular sheet for storing rings.

3. The jewelry storage organizer device of claim 1, further comprising at least one pocket secured to the front surface of the singular sheet for storing jewelry, wherein the at least one pocket comprises a transparent front panel.

4. The jewelry storage organizer device of claim 1, wherein the plurality of tab closures comprise hook and loop closures for opening and closing the tab closures.

5. The jewelry storage organizer device of claim 1, wherein a front surface of the singular sheet comprises a fabric overlay.

* * * * *